US011474455B2

(12) United States Patent
Nedelin et al.

(10) Patent No.: US 11,474,455 B2
(45) Date of Patent: Oct. 18, 2022

(54) PRINTING LIQUIDS CONCENTRATION

(71) Applicant: HP INDIGO B.V., Amstelveen (NL)

(72) Inventors: Peter Nedelin, Ness Ziona (IL); Shai Lior, Ness Ziona (IL); Mark Sandler, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/952,995

(22) Filed: Nov. 19, 2020

(65) Prior Publication Data

US 2021/0072668 A1 Mar. 11, 2021

Related U.S. Application Data

(63) Continuation of application No. 15/772,350, filed as application No. PCT/EP2016/052642 on Feb. 8, 2016, now Pat. No. 10,852,668.

(51) Int. Cl.
*G03G 15/11* (2006.01)

(52) U.S. Cl.
CPC ..... *G03G 15/11* (2013.01)

(58) Field of Classification Search
CPC ..... G03G 15/11
See application file for complete search history.

(56) References Cited

U.S. PATENT DOCUMENTS 4,204,766 A 5/1980 Harada
4,761,357 A 8/1988 Tavernier et al.
4,974,027 A 11/1990 Landa et al.
5,383,008 A 1/1995 Sheridon
5,610,694 A 3/1997 Lior et al.
5,713,068 A 1/1998 Teschendorf et al.
5,915,153 A 6/1999 Kim et al.
5,933,689 A 8/1999 Kim
6,219,500 B1 4/2001 Byun
6,324,368 B1 11/2001 Seto
6,682,865 B2 1/2004 Viturro et al.
6,850,724 B2 2/2005 Pang et al.
6,856,778 B2 2/2005 Vejtasa et al.
7,400,850 B2 7/2008 Romem
7,471,907 B2 12/2008 Berg et al.
7,544,458 B2 6/2009 Iraqi et al.
8,055,160 B2 11/2011 Bhattacharyya et al.
8,103,194 B2 1/2012 Patton et al.
8,496,324 B2 7/2013 Anthony et al.
9,327,295 B2 5/2016 Lior
9,375,653 B2 6/2016 Sandler
(Continued)

FOREIGN PATENT DOCUMENTS

CN 1209582 3/1999
CN 102812403 12/2012
(Continued)

*Primary Examiner* — Walter L Lindsay, Jr.
*Assistant Examiner* — Geoffrey T Evans
(74) *Attorney, Agent, or Firm* — HP Inc. Patent Department

(57) ABSTRACT

An example system includes a conveyor. The conveyor is not a photoconductor. The system also includes a developer unit. The developer unit is to internally concentrate printing liquid. The developer unit also is to deliver the printing liquid to the conveyor. The system includes a wiper in contact with the conveyor. The wiper is to remove the printing liquid from the conveyor.

19 Claims, 6 Drawing Sheets

(56) References Cited

U.S. PATENT DOCUMENTS

| | | | | |
|---|---|---|---|---|
| 10,852,668 | B2 * | 12/2020 | Nedelin | G03G 15/11 |
| 2003/0113138 | A1 | 6/2003 | Tagansky | |
| 2003/0118361 | A1 | 6/2003 | Shimmura | |
| 2003/0133726 | A1 | 7/2003 | Song | |
| 2007/0140738 | A1 | 6/2007 | Aruga | |
| 2009/0035023 | A1 | 2/2009 | Thompson | |
| 2009/0060587 | A1 | 3/2009 | Tanjo | |
| 2009/0220282 | A1 | 9/2009 | Kato | |
| 2013/0011162 | A1 | 1/2013 | Nelson et al. | |
| 2014/0356029 | A1 | 12/2014 | Sandler | |
| 2015/0209800 | A1 | 7/2015 | Lior | |
| 2015/0298453 | A1 | 10/2015 | Gilan | |
| 2015/0370197 | A1 | 12/2015 | Hirai | |
| 2018/0239273 | A1 | 8/2018 | Nelson | |

FOREIGN PATENT DOCUMENTS

| | | |
|---|---|---|
| EP | 2159269 | 3/2010 |
| GB | 1456210 | 11/1976 |
| WO | WO-9301531 | 1/1993 |
| WO | WO-2011123137 | 10/2011 |
| WO | WO-2013034194 | 3/2013 |
| WO | WO-2013107880 | 7/2013 |
| WO | WO-2014015900 | 1/2014 |
| WO | WO-2016015774 | 2/2016 |

* cited by examiner

300

400

PRINTING LIQUIDS CONCENTRATION

BACKGROUND

Electro-photography (EP) printing devices may form images on a print target by selectively charging or discharging a photoconductive member, such as a photoconductive drum, based on an image to be printed. The selective charging or discharging may form a latent electrostatic image on the photoconductor. Colorants, or other printing liquids, may be developed onto the latent image of the photoconductor, and the colorant or printing liquid may be transferred to the media to form the image on the media. In dry EP (DEP) printing devices, powdered toner may be used as the colorant, and the toner may be received by the media as the media passes below the photoconductor. The toner may be fixed in place as it passes through heated pressure rollers. In some liquid EP (LEP) printing devices, printing liquid may be used as the colorant instead of toner. In some LEP devices, printing liquid may be developed in a developer unit and then selectively transferred to the photoconductor (a "zero transfer"). For example, the printing liquid may have a charge that causes it to be electrostatically attracted to the latent image on the photoconductor. The photoconductor may transfer the printing liquid to an intermediate transfer member (ITM), which may include a transfer blanket, (a "first transfer"), where it may be heated until a liquid carrier evaporates, or substantially evaporates, and resinous colorants melt. The ITM may transfer the resinous colorants to the surface of the print media (a "second transfer"), which may be supported on a rotating impression member (e.g., a rotating impression drum).

DETAILED DESCRIPTION

Figure 1:
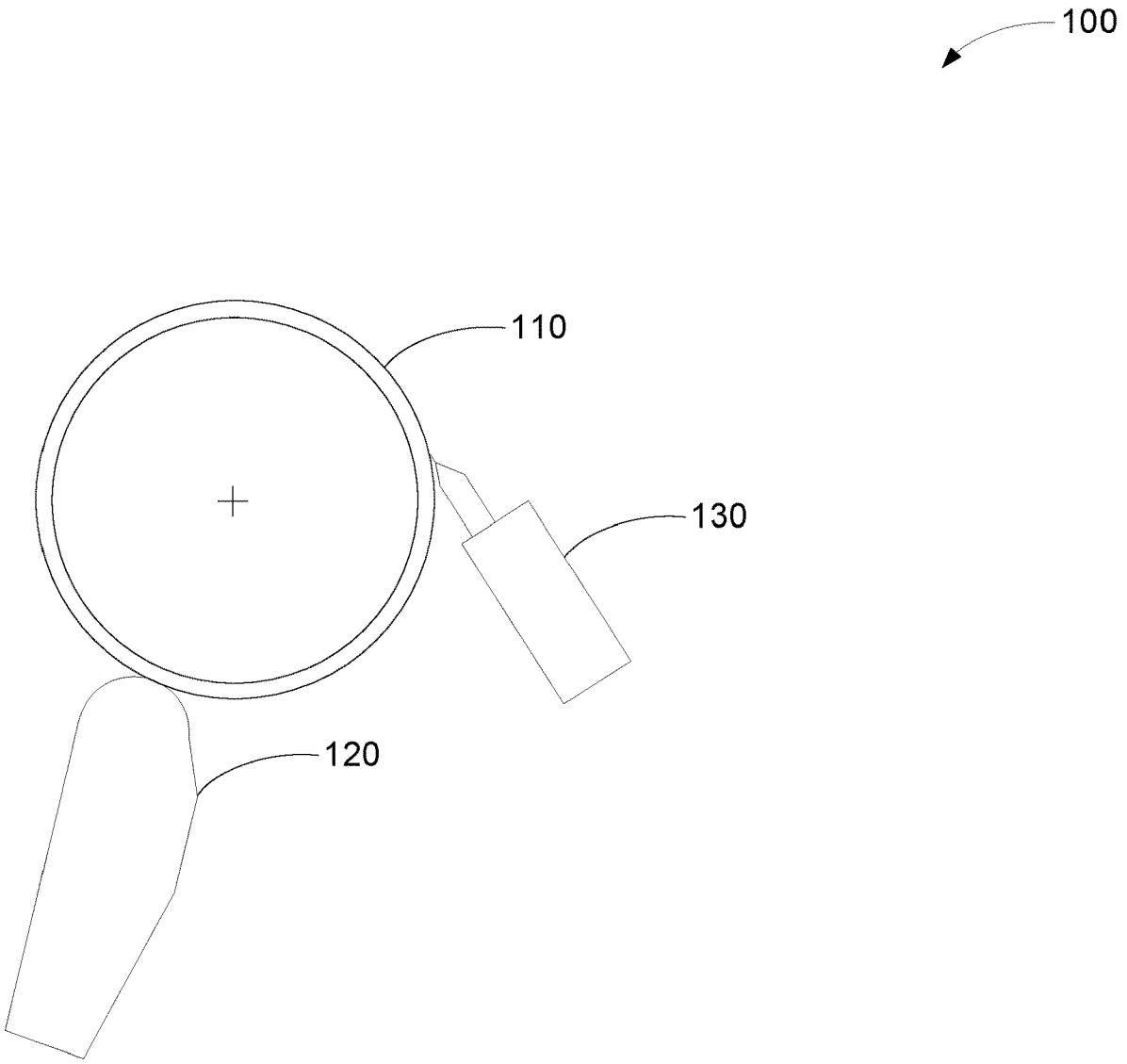
FIG. 1 is a schematic diagram of an example system to concentrate printing liquid.

The printing liquid may include the liquid carrier and non-volatile solids. The liquid carrier may be removed during printing, and the liquid carrier may become waste that needs to be processed by the user. The non-volatile solids may include the colorants that are melted and transferred to the surface of the print media. During manufacturing, the non-volatile solids may be thoroughly mixed in the liquid carrier to ensure an even distribution. In an example, the printing liquid may be mixed to a dilute non-volatile solid concentration of about 3% to 5%. As used herein, the term "non-volatile solid concentration" refers to the mass of the non-volatile solids in a quantity of printing liquid divided by the mass of the quantity of printing liquid including the non-volatile solids.

After the printing liquid has been mixed to the dilute non-volatile solid concentration, the printing liquid may be concentrated to a higher non-volatile solid concentration.

Concentrating the printing liquid may decrease the weight that needs to be shipped for the same quantity of non-volatile solids (i.e., decreases the amount of printing liquid needed to print a particular number of pages). Because less weight is shipped, the shipping cost and environmental impact may be lower. In addition, less liquid carrier waste may be produced during printing. As a result, the end user may have less waste to process.

In an example, the printing liquid may be concentrated in a centrifuge. However, the centrifuge may be noisy and produce a significant amount of vibration. The centrifuge also may operate on small batches of printing liquid and take a long time to concentrate the printing liquid. In addition, the centrifuge may be difficult to clean after the printing liquid has been concentrated. Accordingly, the centrifuge may be inefficient for concentrating printing liquid.

Alternatively, the printing liquid may be concentrated on a conveyor electrophoretically using an electrode. The electrode and the conveyor may be maintained at a potential difference, and the printing liquid may be passed over the electrode. The potential difference may attract the non-volatile solids to the conveyor or repel the non-volatile solids from the electrode. Printing liquid with an increased concentration of non-volatile solids may be deposited on the conveyor. Waste printing liquid with little or no non-volatile solids may flow over the electrode, and the waste printing liquid may be deposited in a waste tank. The printing liquid with the increased concentration of non-volatile solids may be removed from the conveyor and placed in a storage vessel, such as a vessel to be shipped to an end user.

When concentrating the printing liquid with the electrode, the flow of printing liquid to the conveyor may be unstable and non-uniform. In addition, the printing liquid concentration along the width of the conveyor may be non-uniform. The non-volatile solid concentration that can be achieved with the electrode may be lower than desired. The electrode may be difficult to service. The electrode may be inaccessible, may be difficult to clean, and may need to be specially made. The electrode may also be difficult to calibrate and may need precise adjustment of the gap between the electrode and the conveyor. Concentration of printing liquids could be improved by remedying these issues.

FIG. 1 is a schematic diagram of an example system 100 to concentrate printing liquid. The system 100 may include a conveyor 110. In the illustrated example, the conveyor 110 may include a drum. The conveyor 110 may receive printing liquid at its surface and may retain the printing liquid on its surface, for example, electrostatically. The surface of the conveyor 110 may move to transport the printing liquid (e.g., continuously, periodically, aperiodically, or the like). For example, the conveyor 110 may rotate to transport the printing liquid about its circumference.

The system 100 may include a developer unit 120. As used herein, the term "developer unit" refers to a device to internally concentrate printing liquid electrophoretically and to deliver the concentrated printing liquid to a conveyor in contact with the developer unit, such as a photoconductor. In the illustrated example, the developer unit 120 may concentrate printing liquid and conduct the printing liquid to the conveyor 110 rather than delivering the concentrated printing liquid to a photoconductor. However, in some examples, the developer unit 120 may be structurally identical to developer units that deliver printing liquid to photoconductors. In an example, components of the developer unit 120 may be set to larger magnitude electrical potentials when used with the conveyor 110 rather than a photoconductor. The developer unit 120 may concentrate the printing liquid as it transfers the printing liquid to the conveyor 110 in addition to internally concentrating the printing liquid prior to delivering it to the conveyor 110. The developer unit 120 may include channels or conveyors to conduct the printing liquid to the conveyor 110.

The system 100 may include a wiper 130. The wiper 130 may remove the concentrated printing liquid from the conveyor 110. In the illustrated example, the developer unit 120 may deliver concentrated printing liquid to the conveyor 110. The conveyor 110 may rotate clockwise to transport the concentrated printing liquid away from the developer unit 120 and to the wiper 130. The wiper 130 may remove the concentrated printing liquid when it arrives at the wiper 140. In an example, the wiper 130 may scrape the concentrated printing liquid from the surface of the conveyor 110 to remove the concentrated printing liquid.

Figure 2:
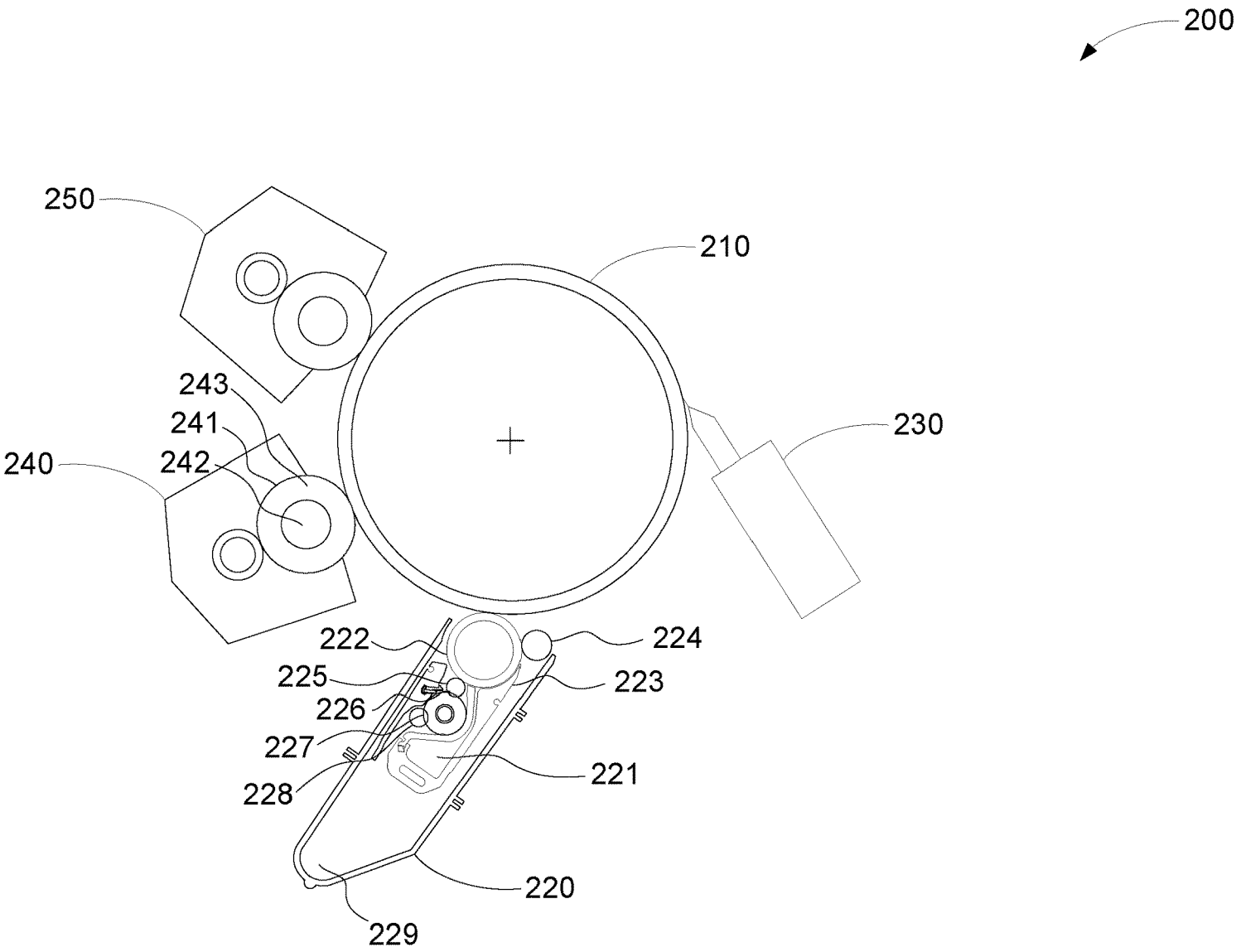
FIG. 2 is a schematic diagram of another example system to concentrate printing liquid.

FIG. 2 is a schematic diagram of another example system 200 to concentrate printing liquid. The system 200 may include a conveyor 210 to transport concentrated printing liquid on its surface. The conveyor 210 may have a continuous surface that forms a loop. In some examples, the conveyor 210 may include a rotatable drum. The surface of the conveyor 210 may support and transport the concentrated printing liquid. The conveyor 210 may have a potential applied to it, and non-volatile solids in the printing liquid may adhere to the conveyor 210 when the potential is applied. The conveyor 210 may include a metal, such as steel, aluminum, copper, an alloy of these metals, or the like. In an example, the conveyor 210 may include a metal substrate covered by a non-metallic material, such as a polymer, an elastomer, a ceramic, or the like.

The system 200 may include a developer unit 220 to deliver concentrated printing liquid to the conveyor 210. The developer unit 220 may include a printing liquid inlet 221 at which it receives printing liquid, which may have a low non-volatile solid concentration. The inlet 221 may deliver the printing liquid to a cavity of an electrode 223. The cavity of the electrode 223 may direct the flow of the printing liquid to a developer roller 222. A potential may be applied to the developer roller 222. For example, the developer roller 222 may be biased to a potential of at most about −500 V, −1000 V, −1500 V, −2000 V, −2500 V, −3000 V, or the like. As used herein, the term "at most" refers to a value that is less than or equal to another value, and the term "at least" refers to a value that is greater than or equal to another value. For example, the value −3000 is less than the value −2500. There may be some error in the applied potential (e.g., an error of 0.1%, 0.5%, 1%, 2%, 5%, etc.). Thus, as used herein, the term "about" a particular voltage refers to a potential that is within an error margin of the particular voltage.

The electrode 223 may concentrate the printing liquid on the developer roller 222. In an example, the electrode 223 may be biased to a potential of at most about −1200 V, −1500 V, −2000 V, −2500 V, −3000 V, −3500 V, −4000 V, or the like. The magnitude of the potential of the electrode 223 may be greater than the magnitude of the potential of the developer roller 222. The non-volatile solids in the printing liquid may be negatively charged, so the non-volatile solids may be repelled away from the electrode 223 and attach to the surface of the developer roller 222. Liquid carrier may attach to the surface of the developer roller 222 as well. Some liquid carrier with little or no non-volatile solids may flow over the electrode 223 and travel to an outlet 229. Accordingly, the electrode 223 may remove liquid carrier from the printing liquid thereby concentrating the printing liquid on the surface of the developer roller 222.

The developer roller 222 may rotate and transport the printing liquid on its surface to a squeegee roller 224. The squeegee roller 224 may be biased to a potential of at most about −800 V, −1000 V, −1500 V, −2000 V, −2500 V, −3000 V, −3500 V, or the like. The magnitude of the potential of the squeegee roller 224 may be greater than the magnitude of the potential of the developer roller 222. The non-volatile solids may remain on the surface of the developer roller 222 due to the potential difference, but the squeegee roller 224 may apply a mechanical force that removes some of the liquid carrier, which may travel to the outlet 229. For example, the squeegee roller 224 may be in contact with the developer roller 222, and the squeegee roller 224 may rotate to pull the liquid carrier from the developer roller 222. The removal of the liquid carrier by the squeegee roller 224 may further concentrate the printing liquid on the surface of the developer roller 222.

The developer roller 222 may transport the printing liquid concentrated by the electrode 223 and the squeegee roller 224 to the conveyor 210. In an example, the conveyor 210 may be biased to a potential of at least or at most about 1500 V, 1000 V, 500 V, 0 V, −500 V, or the like. The potential difference between the developer roller 222 and the conveyor 210 may cause the printing liquid, including the non-volatile solids, to transfer from the developer roller 222 to the conveyor 210. In some examples, some liquid carrier with little or no non-volatile solids may remain on the developer roller 222, and the printing liquid may be further concentrated during the transfer to the conveyor 210. The concentrated printing liquid on the conveyor 210 may be a non-Newtonian fluid and may have a paste consistency.

The developer roller 222 may be cleaned to remove any printing liquid that did not transfer to the conveyor 210. The developer unit 210 may include a cleaner roller 225 to remove the printing liquid remaining on the developer roller 222. The cleaner roller 225 may be at a positive or negative potential relative to the developer unit 210 depending on whether the cleaner roller 225 is to remove non-volatile solids or just liquid carrier. In an example, the cleaner roller 225 may be biased to a potential of at most or at least about −250 V, −500 V, −1000 V, −1500 V, −2000 V, −2500 V, −3000 V, −3500 V, or the like. A wiper 226 may remove printing liquid from the cleaner roller 225. A sponge roller 227 may move the printing liquid away from the vicinity of the cleaner roller 225 and the wiper 226. A squeezer roller 228 may remove the printing liquid from the sponge roller 227 so that it can drain to the outlet 229.

The system 200 may include a plurality of squeegee units 240, 250 to further concentrate the printing liquid on the conveyor 210. After the developer unit 220 has concentrated the printing liquid and delivered it to the conveyor 210, the conveyor 210 may transport the concentrated printing liquid to a first squeegee unit 240. The first squeegee unit 240 may include a roller 241. In an example, the roller 241 may include a metallic core 242 and a non-metallic coating 243. The roller 241 may be biased to a potential of at most about −500 V, −1000 V, −1500 V, −2000 V, −2500 V, −3000 V, −3500 V, −4000 V, or the like. The roller 241 may apply electrical or mechanical force to the concentrated printing liquid on the surface of the conveyor 210. The roller 241 may rotate to apply a mechanical force to remove liquid carrier from the concentrated printing liquid. The potential of the roller 241 may apply an electrical force that causes the non-volatile solids to remain on the surface of the conveyor 210. Thus, the concentration of the printing liquid on the surface of the conveyor 210 may be increased.

After the first squeegee unit 240 has further concentrated the printing liquid, the conveyor 210 may transport the printing liquid to a second squeegee unit 250. In an example, the second squeegee unit 250 may operate similarly to the first squeegee unit 240 to concentrate the printing liquid on the conveyor 210 further. The conveyor 210 may transport the resulting concentrated printing liquid to a wiper 230. The wiper 230 may remove the concentrated printing liquid from the conveyor 210. In an example, the wiper 230 may include a plate or blade of a rigid material, such as a metal or polymer, in contact with the conveyor 210. The wiper 230 may scrape the concentrated printing liquid from the conveyor 210. The concentrated printing liquid may travel down the wiper 230. For example, gravity may pull the printing liquid down the wiper 230. Alternatively, or in addition, the rotation of the conveyor 210 may continuously push additional printing liquid onto the wiper 230, which in turn may push the printing liquid already on the wiper 230. The wiper 230 may transport the printing liquid to further processing or to a storage vessel (not shown), such as a storage vessel to be shipped to a user.

In an example, the printing liquid inlet 221 may receive the printing liquid at a non-volatile solid concentration of no more than 5% (e.g., less than 1%, 1% to 3%, 3% to 5%, etc.) or the like. This concentration may allow mobility of colorant particles in an electrostatic field. The developer unit 220 may concentrate the printing liquid to a non-volatile solid concentration of at least 13%, 15%, 18%, 20%, 23%, 25%, or the like. The squeegee units 240, 250 may further concentrate the printing liquid to a non-volatile solid concentration of at least 15%, 20%, 25%, 30%, 35%, 40%, 45%, 50% or the like. The printing liquid may be provided to the end user at that concentration.

The system 200 may output concentrated printing liquid at a normalized rate of at least five, six, seven, eight, nine, ten, or the like kilograms per hour. As used herein, the term "normalized rate" refers to a rate corrected for the concentration of the printing liquid. For example, the rate may be normalized to that of a liquid with a 100% non-volatile solid concentration. The system 200 may produce a layer on the conveyor 210 with a thickness of at least 1 micrometer (μm), 2 μm, 3 μm, 4 μm, 5 μm, or the like. The thickness may be before or after further concentration by the squeegee units 240, 250. The system 200 may produce printing liquid with a high non-volatile solid concentration at a high rate. The developer unit 220 may provide a stable and uniform flow of printing liquid to the conveyor 210, and the developer unit 220 may deliver a uniform concentration of printing liquid along the entire width of the conveyor 210. The developer unit 220 may be accessed easily and may be a mass produced printer part that can be replaced inexpensively and quickly when servicing the system 200. In addition, there may be no need to align or clean a gap between the developer unit 220 and the conveyor 210. Thus, the system 200 may provide excellent performance concentrating printing liquid with low maintenance costs.

Figure 3:
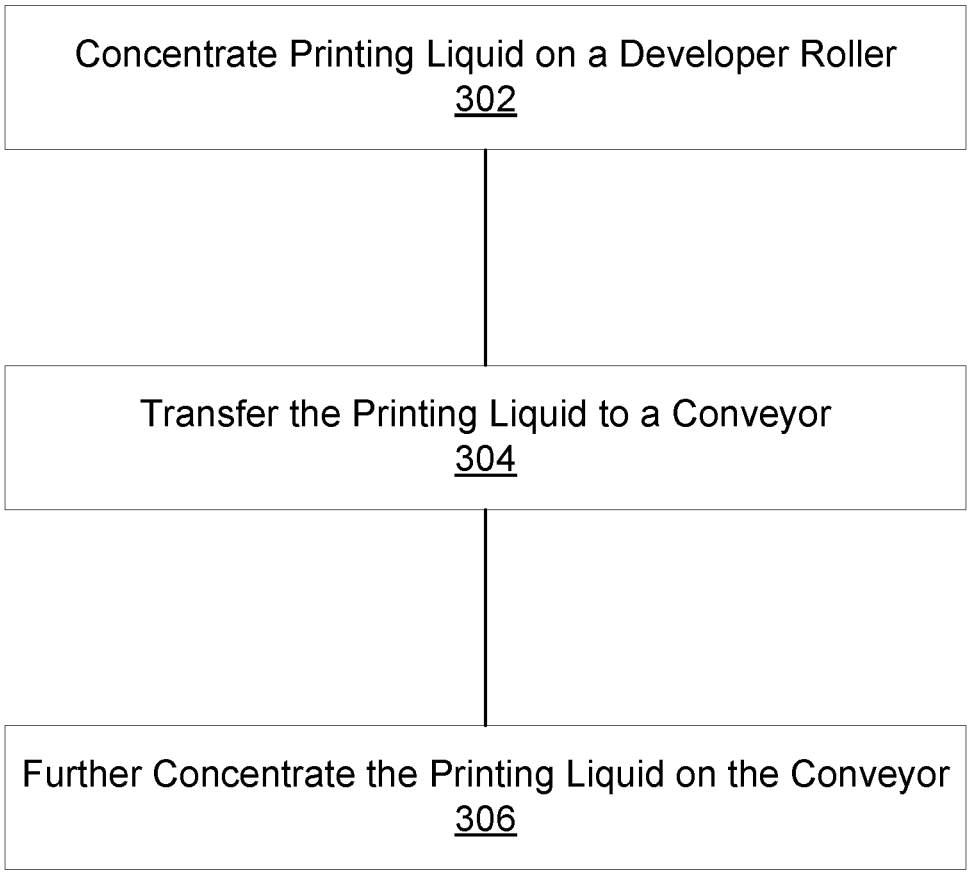
FIG. 3 is a flow diagram of an example method to concentrate printing liquid.

FIG. 3 is a flow diagram of an example method 300 to concentrate printing liquid. At block 302, the method 300 may include concentrating printing liquid on a developer roller. For example, liquid carrier may be removed from the printing liquid on the developer roller to yield a higher concentration of non-volatile solids in the remaining printing liquid. Mechanical or electrical force may be applied to the printing liquid to concentrate the printing liquid. For example, an electrical force may be applied to the non-volatile solids to drive the non-volatile solids toward the developer roller, and a mechanical force may be applied to remove liquid carrier from the printing liquid.

Block 304 may include transferring the printing liquid to a conveyor. In an example, the developer roller may be in contact with the conveyor. Electrical or mechanical force may be applied to the printing liquid to transfer the printing liquid from the developer roller to the conveyor. The conveyor may be at a higher potential than the developer roller to drive negatively charged non-volatile solids in the printing liquid toward the conveyor. The surface of the conveyor may move relative to the developer roller to pull the printing liquid off the developer roller. The non-volatile solid concentration may or may not increase during transfer to the conveyor.

Block 306 may include further concentrating the printing liquid on the conveyor. Liquid carrier may be removed from the printing liquid on the surface of the conveyor to increase the concentration of non-volatile solids. For example, mechanical or electrical force may be applied to the printing liquid to pull the liquid carrier off the conveyor without removing the non-volatile solids from the conveyor. Accordingly, there may be a higher concentration of non-volatile solids in the liquid carrier remaining on the conveyor. In an example, the developer unit 220 of FIG. 2 may perform blocks 302 and 304, and the first squeegee unit 240 may perform block 306.

Figure 4:
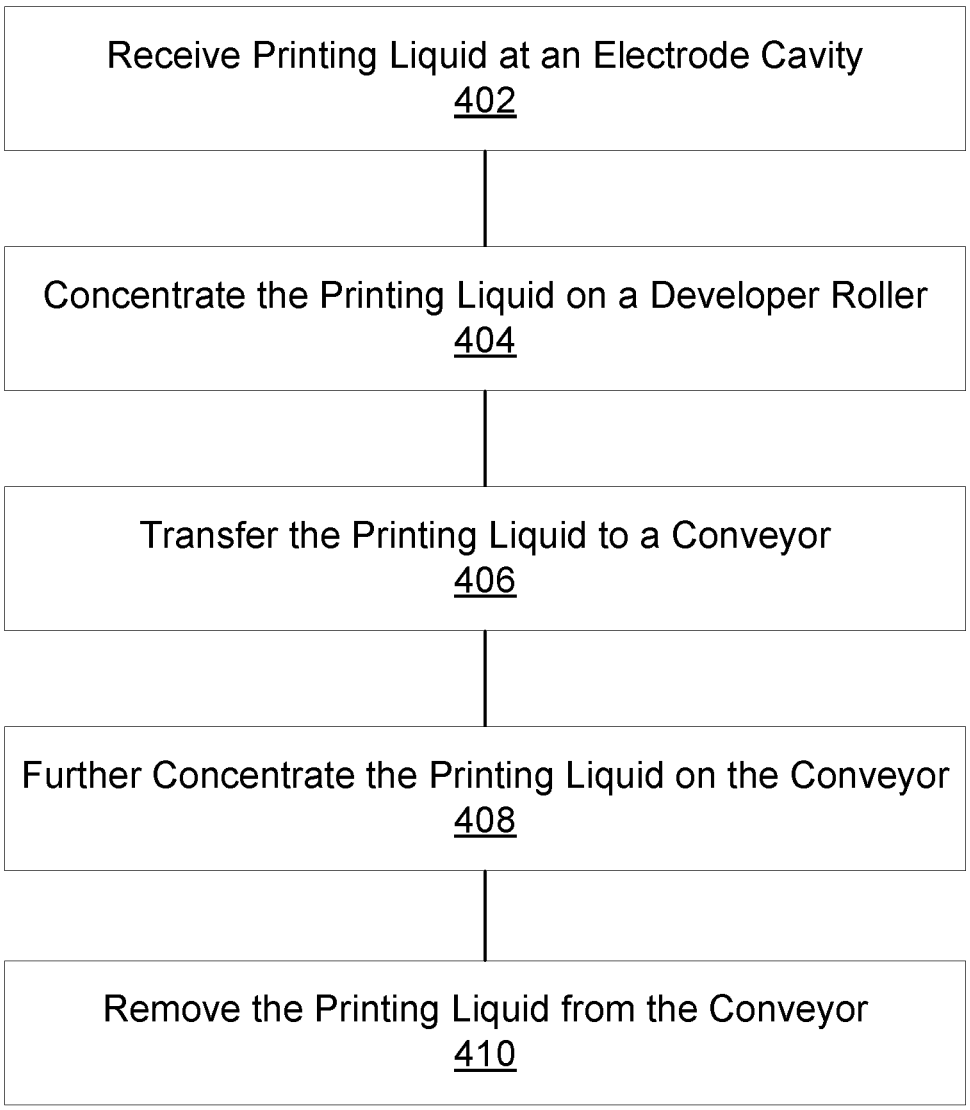
FIG. 4 is a flow diagram of another example method to concentrate printing liquid.

FIG. 4 is a flow diagram of another example method 400 to concentrate printing liquid. At block 402, the method 400 may include receiving printing liquid at an electrode cavity. For example, a developer unit may include the electrode cavity and an adjacent inlet. The printing liquid may flow into the electrode cavity from the inlet. The printing liquid may flow through the electrode cavity to a developer roller. The printing liquid may arrive at the surface of the developer roller, and the developer roller may transport the printing liquid away from the electrode cavity. In an example, the printing liquid received at the electrode cavity may include a non-volatile solid concentration of no more than 5% (e.g., less than 1%, 1% to 3%, 3% to 5%, etc.).

Block 404 may include concentrating the printing liquid on the developer roller. An electrode (e.g., an electrode defining the electrode cavity) may provide an electrical force that repels non-volatile solids from the electrode and toward the developer roller. For example, the non-volatile solids may have a negative charge, and the electrode may be set to a lower electrical potential than the developer roller. Liquid carrier may flow over the electrode and away from the developer roller while the non-volatile solids remain on the developer roller. Alternatively, or in addition, the developer roller may transport the printing liquid to a squeegee roller. The squeegee roller may apply mechanical or electrical force to the printing liquid on the developer roller. For example, the squeegee roller may be set to a lower electrical potential than the developer roller, but its rotation may carry the printing liquid away from the developer roller. As a result, the mechanical and electrical forces may pull liquid carrier away from the developer roller while pushing non-volatile solids toward the developer roller. The electrode or squeegee roller may increase the concentration of non-volatile solids by removing the liquid carrier from the developer roller while the non-volatile solids remain on the developer roller.

At block 406, the method 400 may include transferring the printing liquid to a conveyor. The developer roller may be in contact with the conveyor, and the developer roller and conveyor may rotate. In addition, the conveyor may be at a higher electrical potential than the developer roller. The rotation and electrical potential may apply mechanical and electrical forces on the printing liquid that cause the printing liquid to transfer from the developer roller to the conveyor. In some examples, the concentration of the printing liquid may increase when it is transferred to the conveyor. The printing liquid transferred to the conveyor may have a non-volatile solid concentration of at least 13%, 15%, 18%, 20%, 23%, 25%, or the like.

At block 408, the method 400 may include further concentrating the printing liquid on the conveyor. For example, a squeegee unit may apply electrical or mechanical force to the printing liquid to remove additional liquid carrier from the printing liquid. The squeegee unit may include a roller that rotates to pull the liquid carrier away from the conveyor while an electrical potential between the roller and the conveyor pushes non-volatile solids towards the conveyor. The printing liquid that remains on the conveyor may have a higher non-volatile solid concentration after the additional liquid carrier is removed. In an example, the printing liquid may be further concentrated to a non-volatile solid concentration of at least 15%, 20%, 25%, 30%, 35%, 40%, 45%, 50%, or the like. In an example, the number of squeegee units used to concentrate the printing liquid may be selected based on the desired non-volatile solid concentration.

Block 410 may include removing the printing liquid from the conveyor. In an example, the printing liquid may be removed from the conveyor by scraping the printing liquid from the conveyor. A wiper that includes a rigid blade or plate may be in contact with the conveyor, and the rigid blade or plate may scrape the printing liquid from the conveyor. The wiper may span the width of the conveyor. The printing liquid may travel down the wiper to further processing or to a storage vessel. Referring to FIG. 2, the developer unit 220, for example, may perform blocks 402, 404, and 406; the first squeegee unit 240, for example, may perform block 408; and the wiper 230, for example, may perform block 410.

Figure 5:
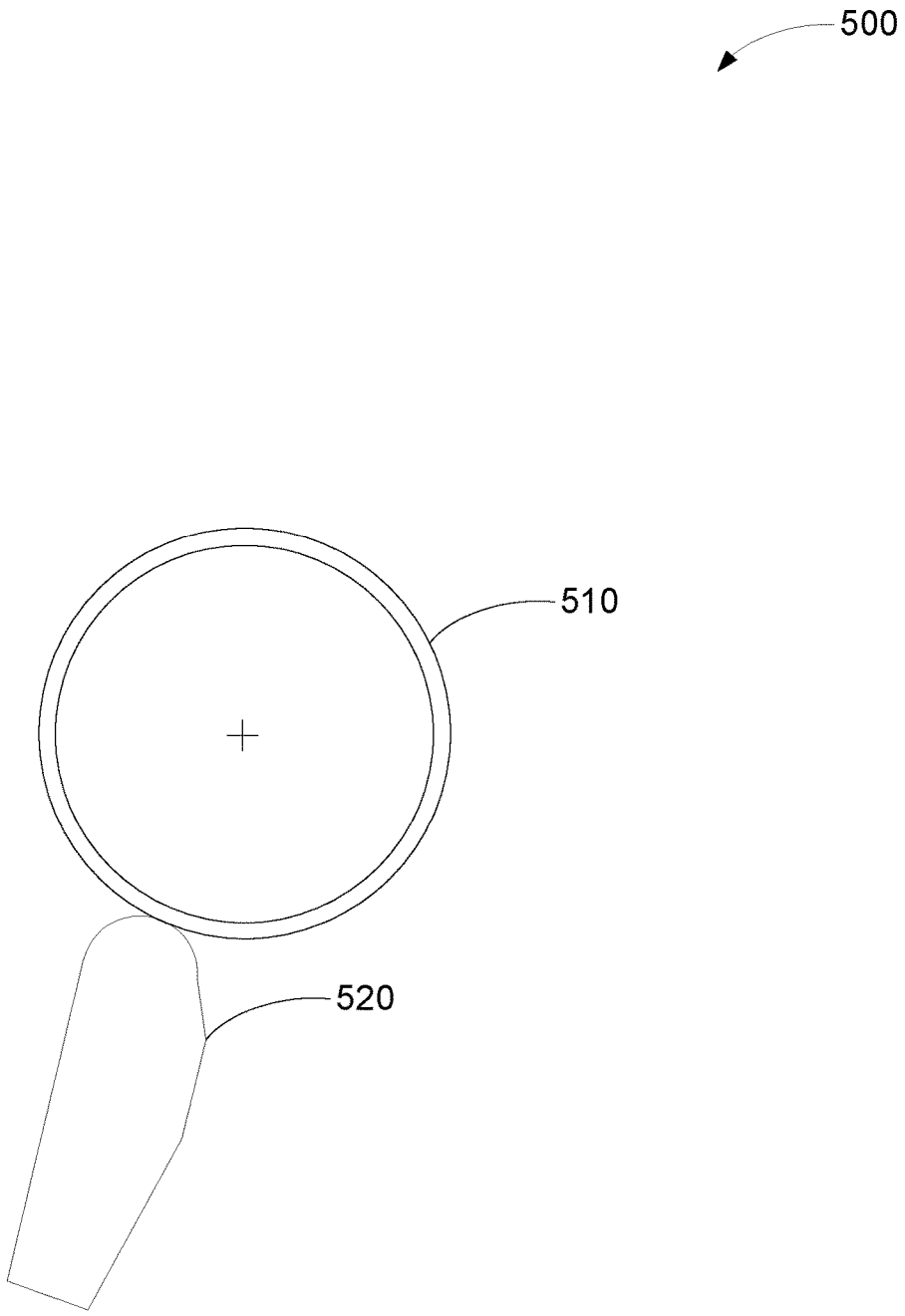
FIG. 5 is a schematic diagram of an example apparatus to concentrate printing liquid.

FIG. 5 is a schematic diagram of an example apparatus 500 to concentrate printing liquid. The apparatus 500 may include a conveyor 510. The conveyor 510 may carry printing liquid on its surface and transport the printing liquid. For example, the surface of the conveyor 510 may move to transport the printing liquid. In an example, the surface may move in a loop. In the illustrated example, the conveyor 510 may include a drum, which may transport the printing liquid by rotating.

The apparatus 500 may also include a developer unit 520. The developer unit 520 may concentrate the printing liquid. For example, the developer unit 520 may remove liquid carrier from the printing liquid to increase the concentration of non-volatile solids in the printing liquid. The developer unit 520 may deliver the printing liquid to the conveyor 510. The developer unit 520 may deliver the printing liquid as a thick layer on the conveyor 510. As used herein, the term delivering a "thick layer" refers to delivering a layer with a thickness of at least 1 μm, 2 μm, 3 μm, 4 μm, 5 μm, or the like. The printing liquid may be delivered to the conveyor at a normalized rate of at least five, six, seven, eight, nine, ten, or the like kilograms per hour. The thick layer may be too thick for delivery to a photoconductor for printing. However, the thick layer may allow for high throughput production of concentrated printing liquid. The developer unit 520 may be operated at high potentials to produce the thick layer of printing liquid.

Figure 6:
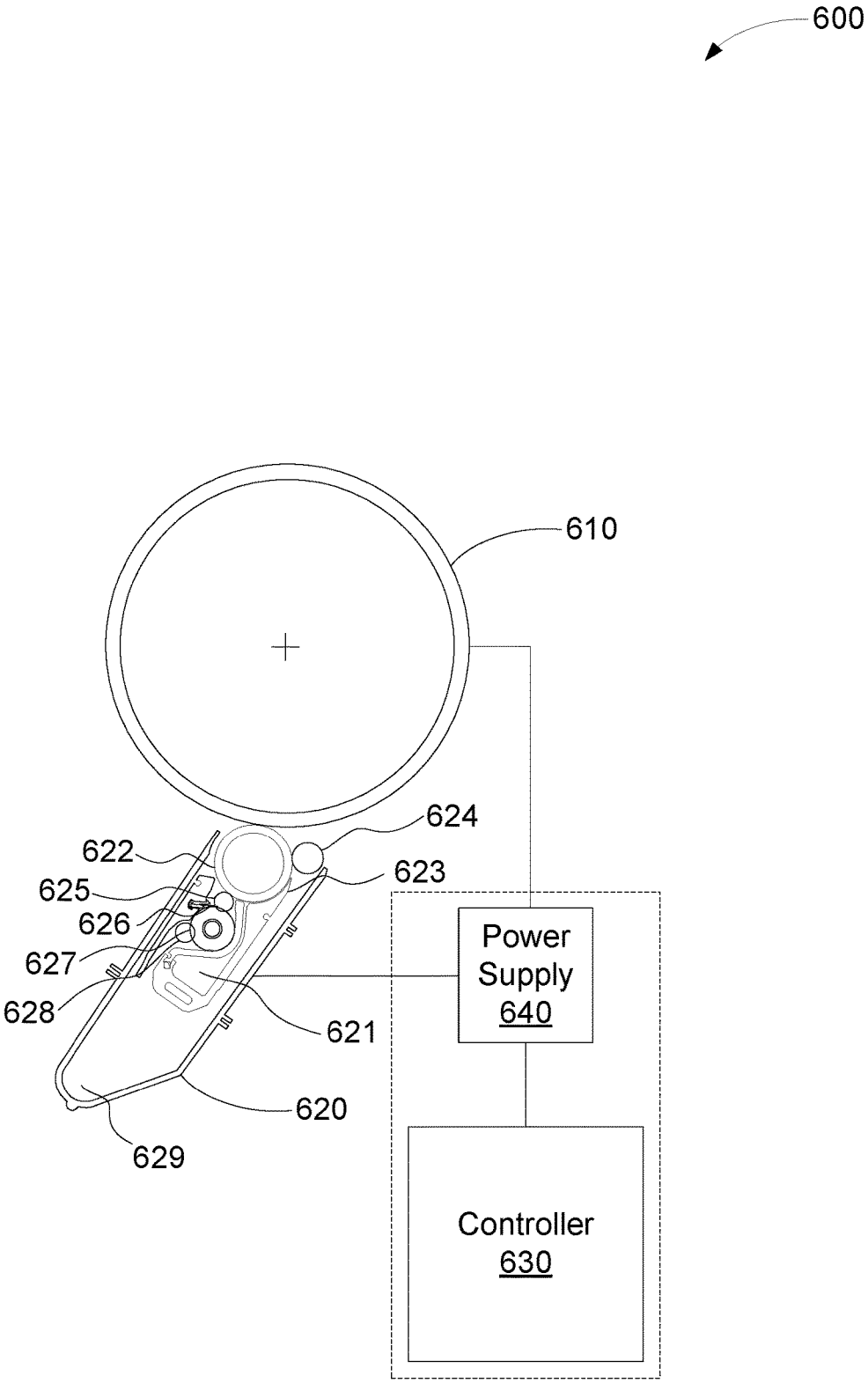
FIG. 6 is a schematic diagram of another example apparatus to concentrate printing liquid.

FIG. 6 is a schematic diagram of another example apparatus 600 to concentrate printing liquid. The apparatus 600 may include a conveyor 610 to transport printing liquid. For example, the conveyor 610 may include a rotating drum to transport the printing liquid. The apparatus 600 may also include a developer unit 620. The developer unit 620 may receive printing liquid at a printing liquid inlet 621 and conduct the printing liquid to a developer roller 622. The developer unit 620 may concentrate the printing liquid on the developer roller 622. For example, the developer unit 620 may apply mechanical or electrical forces to the printing liquid on the developer roller 622 to remove liquid carrier from the printing liquid thereby increasing the concentration of non-volatile solids in the printing liquid. An electrode 623 or squeegee roller 624 may apply the mechanical or electrical forces to the printing liquid to concentrate the printing liquid.

After concentrating the printing liquid, the developer unit 620 may deliver the printing liquid to the conveyor 610. The developer roller 622 may transport the printing liquid to the conveyor 610, for example, by rotating the printing liquid until it reaches the conveyor 610. The developer roller 622 and the conveyor 610 may apply mechanical or electrical force to the printing liquid to transfer the printing liquid to the conveyor 610. The developer unit 620 may deliver the printing liquid as a thick layer on the conveyor 610. For example, the layer of printing liquid may have a thickness of at least 1 μm, 2 μm, 3 μm, 4 μm, 5 μm, or the like. The developer unit 620 may deliver the printing liquid to the conveyor 610 at a normalized rate of at least five, six, seven, eight, nine, ten, or the like kilograms per hour. The developer unit 620 may operate at large magnitude potentials to produce the thick layer of printing liquid.

The apparatus 600 may include a power supply 640 to apply the electrical potentials to the conveyor 610 or elements of the developer unit 620. The apparatus 600 may also include a controller 630 to instruct the power supply 640 at which potential to set each element. In the illustrated example, there is a single integral controller 630 and a single integral power supply 640. In other examples, the functions of the controller 630 and the power supply 640 may be distributed among a plurality of controllers and power supplies. As used herein, the term "controller" refers to hardware (e.g., a processor, such as an integrated circuit, or analog or digital circuitry) or a combination of software (e.g., programming such as machine- or processor-executable instructions, commands, or code such as firmware, a device driver, programming, object code, etc.) and hardware. Hardware includes a hardware element with no software elements such as an application specific integrated circuit (ASIC), a Field Programmable Gate Array (FPGA), etc. A combination of hardware and software includes software hosted at hardware (e.g., a software module that is stored at a processor-readable memory such as random access memory (RAM), a hard-disk or solid-state drive, resistive memory, or optical media such as a digital versatile disc (DVD), and/or executed or interpreted by a processor), or hardware and software hosted at hardware. The term "power supply" refers to hardware to output electrical energy at particular voltages. For example, the power supply 640 may output electrical energy at voltages indicated to the power supply 640. The power supply 640 may modify the voltages dynamically, for example, based on communications from the controller 630. The power supply 640 may include software as well as hardware in some examples.

The controller 630 and the power supply 640 may apply a potential of at most about −500 V, −1000 V, −1500 V, −2000 V, −2500 V, −3000 V, or the like to the developer roller 622. The controller 630 and the power supply 640 may apply electrical potentials to the electrode 623 and the squeegee roller 624 that are less or much less than the potential of the developer roller 622 to concentrate the printing liquid on the developer roller 622. For example, the controller 630 and the power supply 640 may apply a potential of at most about −1200 V, −1500 V, −2000 V, −2500 V, −3000 V, −3500 V, −4000 V, or the like to the electrode 623 and a potential of at most about −800 V, −1000 V, −1500 V, −2000 V, −2500 V, −3000 V, −3500 V, or the like to the squeegee roller 624. The controller 630 and the power supply 640 may apply an electrical potential to the conveyor 610 that is greater or much greater than the electrical potential of the developer roller 622 to transfer the printing liquid to the conveyor 610. The controller 630 and the power supply 640 may apply a potential of at least or at most about 1500 V, 1000 V, 500 V, 0 V, −500 V, or the like to the conveyor 610. The controller 630 and the power supply 640 may apply large magnitude potentials to allow for concentration of more printing liquid and to provide a higher throughput.

The developer unit 620 may also include a cleaner roller 625. The controller 630 and the power supply 640 may apply a potential to the cleaner roller 625. The potential of the cleaner roller 625 may be greater than or less than the potential of the developer roller 622. For example, the cleaner roller 625 may be at a potential less than the developer roller 622 so that the cleaner roller 625 removes liquid carrier from the developer roller 622 but does not remove non-volatile solids from the developer roller 622. The controller 630 and the power supply 640 may apply a potential of at most or at least about −250 V, −500 V, −1000 V, −1500 V, −2000 V, −2500 V, −3000 V, −3500 V, or the like to the cleaner roller 625. The developer unit 620 may include a wiper 626, a sponge roller 627, and a squeezer roller 628 to remove the printing liquid from the cleaner roller 625 and to transport the printing liquid to an outlet 629.

The above description is illustrative of various principles and implementations of the present disclosure. Numerous variations and modifications will become apparent to those skilled in the art once the above disclosure is fully appreciated. Accordingly, the scope of the present application should be determined only by the following claims.

What is claimed is:

1. A system comprising:

a conveyor, wherein the conveyor is not a photoconductor;

a developer unit including a developer roller and an electrode or a squeegee roller proximate to the developer roller to internally concentrate printing liquid on the developer roller, the developer roller to conduct the printing liquid to the conveyor after internal concentration on the developer roller;

a wiper in contact with the conveyor, the wiper to remove the printing liquid from the conveyor.

2. The system of claim 1, further comprising a first squeegee unit to concentrate the printing liquid on the conveyor by removing liquid carrier from the printing liquid.

3. The system of claim 2, further comprising a second squeegee unit to further concentrate the printing liquid on the conveyor.

4. The system of claim 1, wherein the developer unit includes the electrode to concentrate the printing liquid on the developer roller by creating an electrical potential difference between the developer roller and the electrode.

5. The system of claim 1, wherein the developer unit includes the squeegee roller to apply mechanical and electrical forces to the printing liquid on the developer roller to concentrate the printing liquid.

6. A method comprising:

concentrating printing liquid on a developer roller by creating an electrical potential difference between the developer roller and an electrode or a squeegee roller proximate to the developer roller;

transferring the printing liquid to from the developer roller to a conveyor after the concentrating on the developer roller, wherein the conveyor is not a photoconductor;

removing the concentrated printing liquid from the conveyor; and putting the concentrated printing liquid in a storage vessel.

7. The method of claim 6, further comprising removing the printing liquid from the conveyor, wherein the printing liquid has a non-volatile solid concentration of at least 30% when removed from the conveyor.

8. The method of claim 6, further comprising receiving the printing liquid at an electrode cavity, wherein the printing liquid flows through the electrode cavity to the developer roller.

9. The method of claim 8, wherein receiving the printing liquid comprises receiving the printing liquid at a non-volatile solid concentration of no more than 5%.

10. The method of claim 6, wherein the printing liquid transferred to the conveyor has a non-volatile solid concentration of at least 20%.

11. The method of claim 6, wherein removing the concentrated printing liquid from the conveyor comprises removing the concentrated printing liquid from the conveyor at a normalized rate of at least five kilograms per hour.

12. An apparatus comprising:

a conveyor; and a developer unit including a developer roller and an electrode or a squeegee roller proximate to the developer roller to internally concentrate printing liquid received on the developer roller at a non-volatile solid concentration of no more than 5%, the developer roller to conduct the printing liquid to the conveyor after internal concentration on the developer roller;

a wiper in contact with the conveyor, the wiper to remove the printing liquid from the conveyor, wherein the removed printing liquid has a non-volatile solid concentration of at least 35%.

13. The apparatus of claim 12, wherein the developer unit is to deliver the printing liquid to the conveyor with a thickness of at least 3 micrometers.

14. The apparatus of claim 12, further comprising a controller to set the developer roller to a voltage with a magnitude of at least 500V relative to the conveyor.

15. The apparatus of claim 14, wherein the developer unit includes the electrode to concentrate the printing liquid on the developer roller, and wherein the controller is to set the electrode to a voltage with a magnitude of at least 1,200 V.

16. The apparatus of claim 14, wherein the developer unit includes the squeegee roller to concentrate the printing liquid on the developer roller, and wherein the controller is to set the squeegee roller to a voltage with a magnitude of at least 800 V.

17. The apparatus of claim 12, further comprising a controller to create a potential difference between the developer roller and the electrode or the squeegee roller to internally concentrate the printing liquid.

18. The apparatus of claim 12, wherein the conveyor is not a photoconductor.

19. The apparatus of claim 12, wherein the conveyor comprises a metal substrate covered by a non-metallic material.

* * * * *